United States Patent [19]

Grimes et al.

[11] Patent Number: 4,761,630

[45] Date of Patent: Aug. 2, 1988

[54] BUTT-LAP-STEP CORE JOINT

[75] Inventors: Frank H. Grimes; Eugenius Hammack, both of Athens, Ga.

[73] Assignee: Westinghouse Electric Corp., Pittsburgh, Pa.

[21] Appl. No.: 107,225

[22] Filed: Oct. 9, 1987

[51] Int. Cl.[4] ..... H01F 27/26

[52] U.S. Cl. ..... 336/213; 336/217

[58] Field of Search ..... 336/213, 216, 217, 212; 29/607, 609

[56] References Cited

U.S. PATENT DOCUMENTS

| | | | |
|---|---|---|---|
| 2,931,993 | 4/1960 | Dornbush | 336/217 |
| 3,025,483 | 3/1962 | Treanor | 336/217 X |
| 3,189,860 | 6/1965 | Duenke | 336/217 |

*Primary Examiner*—Thomas J. Kozma

*Attorney, Agent, or Firm*—B. R. Studebaker

[57] ABSTRACT

An improved transformer core joint for use in connection with amorphous metal transformers which includes a plurality of spirally wound laminations that are divided into a plurality of groups of laminations. The laminations within a group of laminations essentially provide a butt joint within the group while adjacent groups of laminations form a lap joint with each other. The groups of laminations are divided into sets of groups and a step either in the direction of the spiral or against the direction of the spiral occurs between each of the sets of groups. The joint of the invention provides a compact, easily disassembled and reassembled core joint for accommodating the manufacture of amorphous metal transformer cores.

19 Claims, 3 Drawing Sheets

BUTT-LAP-STEP CORE JOINT

BACKGROUND OF THE INVENTION

This invention relates in general to magnetic cores and core coil assemblies for electrical inductive apparatus, such as distribution transformers, and more specifically to a new and improved amorphous metal magnetic core construction.

Amorphous metal alloys, such as Allied Metglas Products 2605SC and 2605S-2, exhibit a relatively low no load loss when used in the magnetic core of an electrical transformer. Thus the user of amorphous metal alloys appears to be an attractive alternative to conventional grain oriented electrical steel in the construction of magnetic cores for electrical distribution transformers. Although amorphous metal has a higher initial cost then conventional grain oriented electrical steel, the cost difference may be more than offset over the operating life of a transformer by the savings in energy which otherwise would have to be generated to supply the higher losses.

Amorphous metal alloy, however, cannot simply be substituted for conventional electrical steel in the transformer manufacturing process. Amorphous metals possess characteristics which create manufacturing problems which must be economically solved before production line transformers utilizing amorphous metal cores will be readily available in the market place.

For example, amorphous metal is very thin, having a nominal thickness of about 1 mil. Amorphous metal is also very brittle, especially after stress relief anneal, which anneal is necessary after the core is formed of amorphous metal because amorphous metals are very stress sensitive. The no load losses of amorphous metals increase significantly after being wound or otherwise formed into the shape of a magnetic core suitable for distribution transformers. The no load loss characteristic is then restored by the stress relief anneal.

The thin, brittle amorphous metal strip also makes the forming of the conventional core joint a difficult manufacturing problem. While the use of a jointless core solves the joint problem, it complicates the electrical windings. Conventional electrical windings, which are simply slipped over the core legs before the conventional core joint is closed, cannot be used with an unjointed core. Techniques are available for winding the high and low voltage windings directly on the legs of an uncut amorphous core, but, in general, these techniques add manufacturing cost and production line complexity.

Conventionally, a core is formed by winding the core material on a mandrel in the form of a spiral. If a jointed core is contemplated, it is conventional to cut the core along a datum line which is to say that the core is cut straight through along a single radius. If the core is then opened and the high voltage and low voltage coils slipped over the legs and the joint rejoined a butt joint is accomplished with its attendant impediments to the flow of magnetic flux. One solution to this problem is disclosed in Ellis U.S. Pat. No. 3,107,415 in which, after the datum line cut the laminations are moved relative to each other to form a step lap joint from a series of concentric cylinders thus providing a flux path around the butt joints. Another alternative construction involves the datum line cutting of the core with the circumference of the core then slightly reduced so that each lamination or each group of laminations overlap the adjacent lamination or group of laminations to form a lap joint. The disadvantage of this construction is a substantial material buildup in the joint area of the core as well as undesirable air gaps being left adjacent the ends of each lamination or group of laminations.

As will be apparent from the foregoing a core joint is desirable which will avoid the necessity of expensive winding equipment required where a jointless core is used but which will provide as nearly as possible the electrical advantages of the jointless core without having to handle each lamination of the very thin amorphous metal individually, prevent the creation of air gaps in the joint area of the core as well as significant core height buildup in the joint area.

SUMMARY OF THE INVENTION

The present invention is directed to an improved transformer core having a butt-lap-step transformer core joint wherein a plurality of laminations cut from a continuous spiral of material are divided into a plurality of groups of laminations. The laminations within each group are cut to form a butt joint with other laminations of the group and each group of laminations are offset laterally from the adjacent group of laminations to form a lap joint with the adjacent group. The end lamination of each group is of a different length than the majority of laminations within the group and forms the end lamination of the next adjacent group. A preselected number of the groups of laminations comprise a set of groups and the lamination interconnecting two sets of groups is of a substantially different length than the balance of the laminations within the groups and define a step.

The lateral offset between the groups may be in the direction of the spiral or in a direction opposite that of the spiral. When the lateral offset between the groups of laminations is in the direction of the spiral the laminations of a different length are longer than the balance of the laminations within the group and the lamination interconnecting a set of groups with an adjacent set of groups is substantially shorter than the laminations within the groups. When the lateral offset is in a direction opposite the direction of the spiral the laminations of a different length are shorter than the balance of the laminations within the group and the lamination interconnecting a set of groups with an adjacent set of groups is substantially longer than the laminations with the groups.

It is preferable that the number of laminations in a group is between about 5 and 30 laminations and the number of groups of laminations in a set of groups is between about 5 and 25 groups.

The improved transformer core of this invention is preferably of amorphous metal and each lamination of amorphous metal is approximately 1 mil in thickness.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
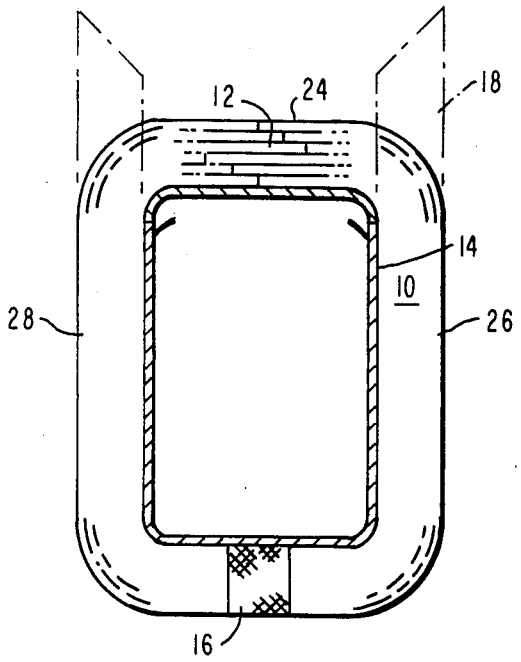
FIG. 1 is an elevational view of a core having a joint constructed in accordance with the present invention before the coils are mounted thereon.

Referring now in detail to the drawings wherein like reference characters represent like parts throughout the several views there is illustrated in FIG. 1 an amorphous metal transformer core employing the joint of the present invention. The core joint of this invention may be manufactured by the method disclosed in copending application Ser. No. 896,781, filed Aug. 15, 1986 for Method Of Making A Magnetic Core now issued as U.S. Pat. No. 4,709,471 dated Dec. 1, 1987 and owned by the assignee of this invention. The novel method of the aforesaid copending application and the apparatus disclosed therein for cutting and amorphous metal core is hereby incorporated herein by reference.

The novel jointed core of this invention is illustrated in FIG. 1 and includes a plurality of spirally wound laminations which may be initially wound as on a round or rectangular mandrel. The circumference of the circular mandrel or the parameter of a rectangular mandrel is determined by the size of the core window desired to accommodate the high and low voltage coils of a finished transformer. Similarly, the number of spirally wound laminations is determined by the ultimate power rating of the transformer.

Figure 2:
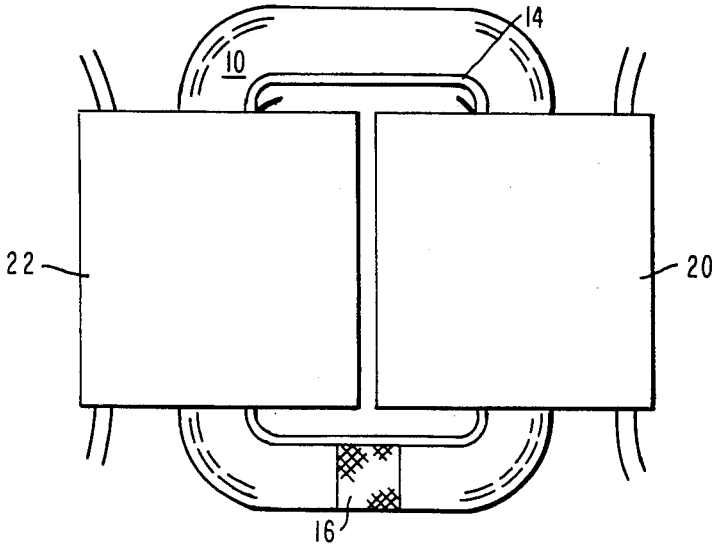
FIG. 2 is an elevational view of the magnetic core shown in FIG. 1 after the coils have been mounted thereon and the joint reclosed.

Referring now to FIG. 1, the magnetic core, generally designated 10, includes a plurality of individual laminations that have been cut to form the joint 12, of this invention. Because of the flexibility of the amorphous metal, a special fixture 14 of the type disclosed in application Ser. No. 896,782 filed Aug. 15, 1986 for Fixture For the Window of a Magnetic Core, now issued as U.S. Pat. No. 4,723,349 on Feb. 9, 1988, and owned by the assignee of this invention, may be employed to maintain the integrity of the core shape. Additionally, a band of adhesive or other suitable clamping means may be employed as at 16 to prevent any relative movement between the cut laminations. As illustrated in Phantom at 18, the joint permits the core to be opened to receive the high and low voltage coils 20 and 22 respectively as illustrated in FIG. 2.

Figure 3:
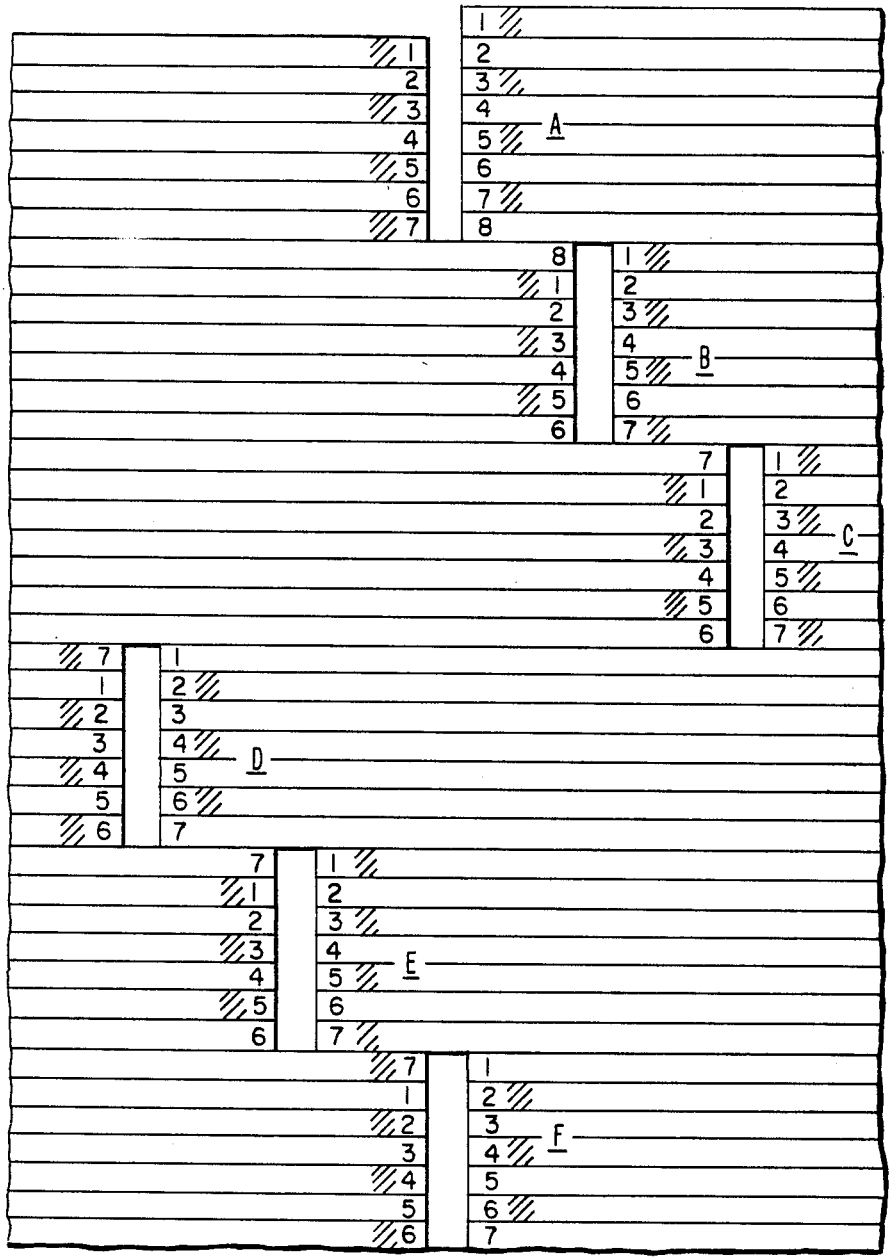
FIG. 3 is a schematic illustration of a core joint of the present invention with the lap joints laterally offset in the direction of the spiral.
Figure 4:
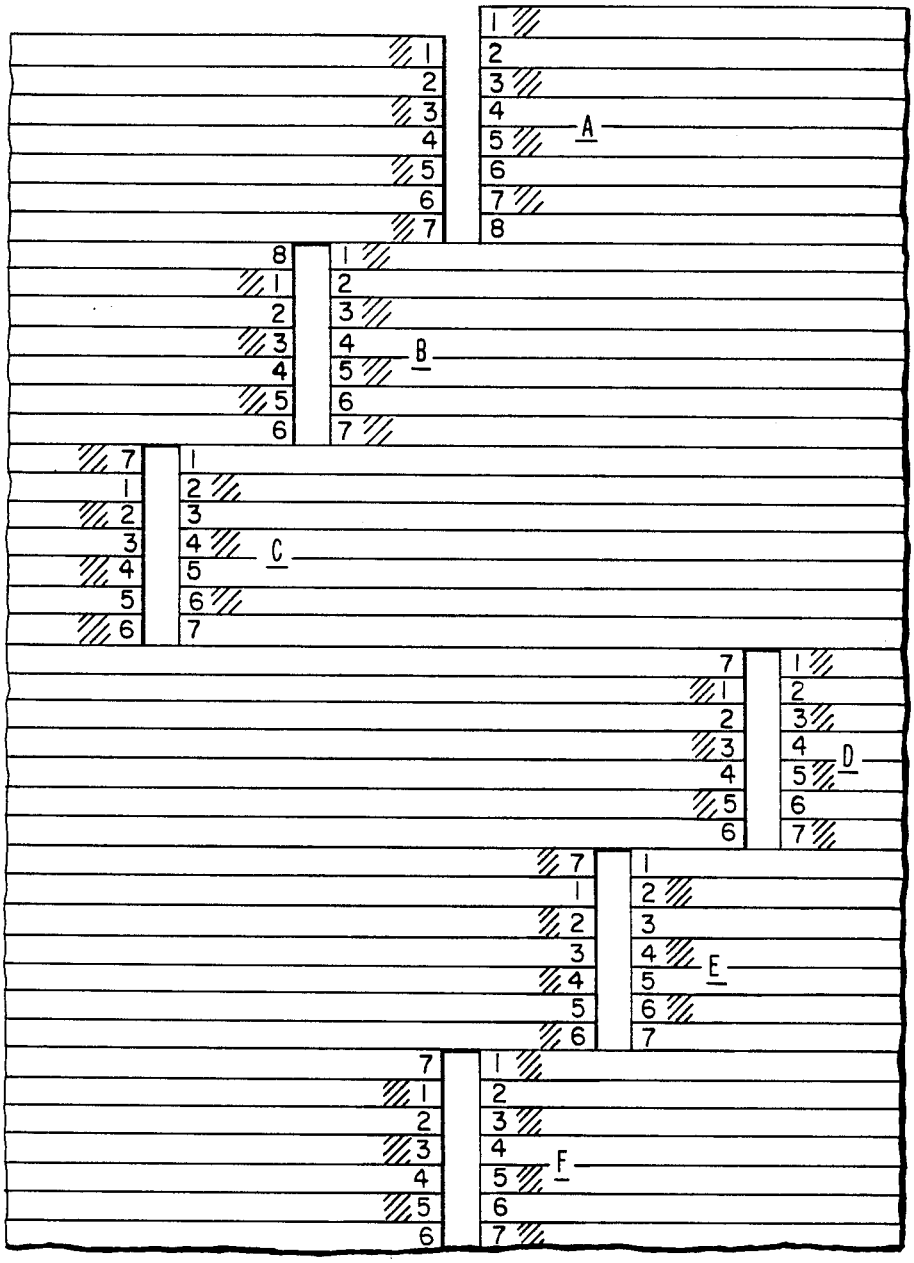
FIG. 4 is a schematic illustration of the core joint of the present invention with the lap joints offset laterally against the direction of the spiral.

As best illustrated schematically in FIGS. 3 and 4, the laminations are divided into a plurality of groups of laminations and several sets of groups of laminations. In FIGS. 3 and 4 approximately 7 laminations have been illustrated as defining a group of laminations but it should be understood that the number of laminations in a group could be from between about 5 and 30 laminations and is preferably approximately 15 laminations. Each group of laminations is offset laterally from its adjacent group of laminations and a certain number of these groups of laminations are defined herein as a set of groups. In the illustration of FIGS. 3 and 4, three groups of laminations constitute a set of groups but it should be understood that the number of groups of laminations in a set of groups of laminations is preferably between about 5 and 25 groups before it is necessary to step back or forward with respect to the direction of the spiral to repeat the sequence. The number of groups of laminations in a set of groups is essentially controlled by the length of the top leg 24 of the rectangular core before that top leg begins to curve to form the side legs 26 and 28 of the core.

In FIGS. 3 and 4 each lamination in each group has been given the numbers 1 through 7 or 8 and the ends of alternate laminations shaded for purposes of illustrating that each lamination is a portion of a true spiral and not concentric cylinders. Additionally, the groups of laminations have been designated A through F to facilitate the description thereof.

Referring more particularly to FIG. 3, which is illustrative of a lateral offset between the groups in the direction of the spiral it will be seen that lamination 8 interconnecting group A with group B and lamination 7 interconnecting group B with group C are slightly longer than the remainder of laminations within the groups to accommodate the lateral offset.

In order to repeat the pattern of a set of groups it will be seen that the lamination 7 of group C which also forms a part of Group D is of a substantially shorter length than the remainder of the laminations in groups C and D and constitutes a short sheet and a step back to restart the series.

Referring now to FIG. 4 where the lateral offsets are in a direction against the direction of the spiral, it will be seen that the lamination 8 interconnecting group A with group B is somewhat shorter than the remainder of the laminations in groups A and B to provide the lap joint and that the step to move the groups back into the area of the center of the top leg of the core as for example lamination 7 which interconnects groups C and D is substantially longer than the remainder of the laminations in groups C and D.

Although both joint configurations provide a substantial improvement in reducing watt losses in the magnetic core and provide for ease of assembly of the core with the coils, it has been found that the total watts of a core in which the lap joints are laterally offset in the direction of the spiral are somewhat better than a core in which the offsets are in a direction opposite to the direction of the spiral.

As described in more detail in copending application Ser. No. 896,781, now U.S. Pat. No. 4,709,471, the core joint of this invention may be cut by separating a preselected number of laminations from the spirally wound core and cutting through the group, laterally displacing either the coil or the cutter to provide the lap joint between groups and after a predetermined number of groups for the set of groups has been cut, moving the core or cutter in the opposite direction to start the cut of the first group in the next set of groups.

A typical 25 KVA transformer amorphous core will include about 2,700 laminations with approximately 15 laminations in a group, 9 groups in a set of groups and about 20 sets of groups in the core.

As will be apparent from the foregoing, the transformer core of this invention which includes butted laminations, lapped laminations and stepped laminations to form a butt-lap-step core provides for improved flux flow through the joint while confining the joint both laterally and vertically to the area of the top leg of the core while eliminating any core buildup in the joint area or air gaps within the joint.

We claim:

1. An improved transformer core having a butt-lap-step transformer core joint, said transformer core comprising:

a plurality of laminations cut from a continuous spiral of material, said plurality of laminations divided into a plurality of groups of laminations;

laminations within each group being cut to form a butt joint with other laminations of said group;

each group of laminations being offset laterally from its adjacent group of laminations for form a lap joint with said adjacent group, the end lamination of each group being of a different length than the majority of laminations within said group and forming the end lamination of the next adjacent group, a preselected number of said groups of laminations comprising a set of groups wherein the lamination interconnecting two sets of groups is of a substantially different length than the balance of the laminations within said groups and define a step.

2. The improved transformer core according to claim 1, wherein said lateral offset between said groups of laminations is in the direction of said spiral.

3. The improved transformer core according to claim 2, wherein said laminations of a different length are longer than the balance of said laminations within said group and the lamination interconnecting a set of groups with an adjacent set of groups is substantially shorter than the laminations within said groups.

4. The improved transformer core according to claim 1, wherein said lateral offset is in a direction opposite to the direction of said spiral.

5. The improved transformer core according to claim 4, wherein said laminations of a different length are shorter than the balance of said laminations within said groups and the lamination interconnecting a set of groups with an adjacent set of groups is substantially longer than the laminations within said groups.

6. The improved transformer core according to claim 1, wherein the number of laminations in a group is between about 5 to 30 laminations.

7. The improved transformer core according to claim 1, wherein the number of groups of laminations in a set of groups is between about 5 and 25 groups.

8. The improved transformer core according to claim 1 wherein said spiral of material is amorphous metal.

9. The improved transformer core according to claim 8 wherein each lamination is approximately 1 mil thick.

10. In a transformer, an improved transformer core having a butt-lap-step transformer core joint, said transformer core comprising:

a plurality of laminations, said plurality of laminations divided into a plurality of groups of laminations;

the majority of laminations in each group being cut to form a butt joint within said group;

each group of laminations being offset laterally from its adjacent group of laminations to form a lap joint with said adjacent group, a preselected number of said groups of laminations comprising a set of groups wherein the innermost lamination of the innermost group of one set of groups and the outermost group of an adjacent set of groups is of a substantially different length than the balance of the laminations within said groups.

11. The improved transformer core according to claim 10, wherein said core comprises a spiral and said lateral offset between said groups of laminations is in the direction of said spiral.

12. The improved transformer core according to claim 11, wherein said lamination of a substantially different length is substantially shorter than the balance of said laminations.

13. The improved transformer core according to claim 10, wherein said core comprises a spiral and said lateral offset is in a direction opposite to the direction of said spiral.

14. The improved transformer core according to claim 13, wherein said lamination of a substantially different length is substantially longer than the balance of said laminations.

15. The improved transformer core according to claim 10, wherein the number of laminations in a group is between about 5 and 30 laminations.

16. The improved transformer core according to claim 10, wherein the number of groups of laminations in a set of groups is between about 5 and 25 groups.

17. The improved transformer core according to claim 10 wherein said laminations comprise amporphous metal.

18. The improved transformer core according to claim 17 wherein each lamination is approximately 1 mil thick.

19. The improved transformer core according to claim 10 wherein the number of laminations in a group of laminations is about 15 and the number of groups in a set of groups is about 9.

* * * * *